US007300566B2

(12) United States Patent
Gunnerman

(10) Patent No.: US 7,300,566 B2
(45) **Date of Patent: *Nov. 27, 2007**

(54) CONVERSION OF PETROLEUM RESID TO USABLE OILS WITH ULTRASOUND

(75) Inventor: Rudolf W. Gunnerman, Reno, NV (US)

(73) Assignee: Sulphco, Inc., Sparks, NV (US)

( * ) Notice: Subject to any disclaimer, the term of this patent is extended or adjusted under 35 U.S.C. 154(b) by 640 days.

This patent is subject to a terminal disclaimer.

(21) Appl. No.: 10/803,802

(22) Filed: Mar. 17, 2004

(65) Prior Publication Data

US 2005/0205463 A1 Sep. 22, 2005

(51) Int. Cl.
*C10G 15/00* (2006.01)

(52) U.S. Cl. ..... 208/106; 208/46; 208/157.15; 208/208 R; 44/904

(58) Field of Classification Search ..... 44/904; 204/157.15; 208/46, 106, 208 R, 157.15
See application file for complete search history.

(56) References Cited

U.S. PATENT DOCUMENTS 5,110,443 A * 5/1992 Gregoli et al. ..... 208/46
6,500,219 B1 * 12/2002 Gunnerman ..... 44/904
2003/0051988 A1 3/2003 Gunnerman et al.

* cited by examiner

*Primary Examiner*—Glenn Caldarola
*Assistant Examiner*—Prem C. Singh
(74) *Attorney, Agent, or Firm*—Townsend and Townsend and Crew LLP; M. Henry Heines

(57) ABSTRACT

Petroleum residua are combined with water or an aqueous solution to form an emulsion which is then treated with ultrasound at a sufficient intensity and for a sufficient period of time to cause a conversion of the heavy hydrocarbon components of the residua to lighter components, thereby shifting the entire boiling point curve to lower boiling points. This allows one to draw a greater proportion of usable oil from the residua.

13 Claims, 1 Drawing Sheet

CONVERSION OF PETROLEUM RESID TO USABLE OILS WITH ULTRASOUND

BACKGROUND OF THE INVENTION

1. Field of the Invention

This invention resides in the field of crude oil and crude oil fractions, and particularly petroleum residuum fractions. In particular, this invention addresses reformation processes for deriving usable oil from, or increasing the usable oil that can be extracted from, petroleum residua.

2. Description of the Prior Art

Crude oil is the largest and most widely used natural resource in the world, serving as a source of a wide range of fuels for consumer and industrial use as well as chemicals for use as raw materials in products used every day worldwide. Petroleum residua (or "resids ") are the heavy fraction remaining after petroleum crudes are distilled at atmospheric pressure or at reduced pressure, i.e., the residue left after the most readily accessible components of the petroleum are extracted. Resids are highly complex in composition, including components of high molecular weight as well as polynuclear aromatics, coke, asphaltenes, resins, small ring aromatics, and saturates. Unfortunately, resids are of extremely limited utility. A variety of conversion processes have been developed to increase the utility of, or obtain useful products from, resids. These processes include separations, thermal conversion, hydroconversion or hydrotreating, and fluid catalytic cracking. The processes that are the most economical, however, result in a carbonaceous byproduct that is even heavier than the starting resid, including further formation of polynuclear aromatics. Processes that involve the use of catalysts are also costly due to the cost of the catalysts themselves and the expense of recovering and recycling the catalysts after use. Also, the petroleum industry is continually seeking ways to utilize resids of lower quality and lower cost due to a continual need for new sources of crude oil and to continuing pressure from the public and regulatory agencies to make use of these resids rather than to dispose of them. As a result, processes that can economically and effectively convert these resids to lighter components are continually needed.

SUMMARY OF THE INVENTION

It has now been discovered that fossil fuels, crude oil fractions, and particularly petroleum resids can be converted to lower boiling mixtures by a process that applies ultrasound to these materials in an aqueous emulsion. The entire boiling point distribution of a resid, ranging from 200° F. to over 1,000° F. (93-540° C.) can be shifted to lower temperatures. Components with boiling points within the range of about 400° F. to about 800° F. (200-430° C.), for example, can have their boiling points lowered by a minimum of 20° F. (11° C.) by this process. The process results in an upgrading of the starting material by increasing the amount of usable oil and other products that can be extracted from the starting material, and by increasing the API gravity and lowering the viscosity of the material. These and other objects, advantages, features, and embodiments of the invention will become apparent from the description that follows.

DETAILED DESCRIPTION OF THE INVENTION AND SPECIFIC EMBODIMENTS

Figure 1:
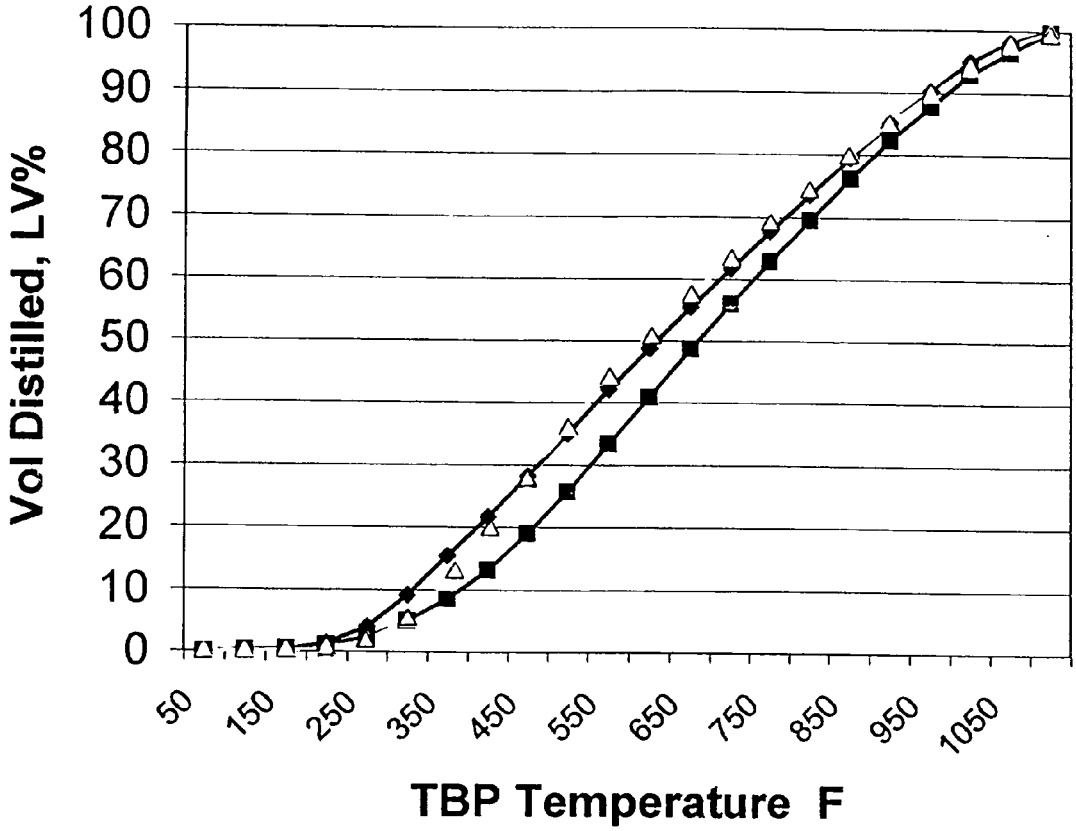
FIG. 1 is a plot, derived by high-temperature simulated distillation, of cumulative volume distilled vs. true boiling point, for a sample of untreated crude oil and for samples treated in accordance with the present invention.

This invention is applicable to any residual carbonaceous liquid that is derived from petroleum, coal, or any other naturally occurring material. Petroleum residua and residuum-based fuel oils, including bunker fuels and residual fuels, are of particular interest. No. 6 fuel oil, for example, which is also known as "Bunker C" fuel oil, is used in oil-fired power plants as the major fuel and is also used as a main propulsion fuel in deep draft vessels in the shipping industry. No. 4 fuel oil and No. 5 fuel oil are used to heat large buildings such as schools, apartment buildings, and office buildings, and large stationary marine engines. The heaviest fractions are resids, including the vacuum residuum from the fractional distillation, commonly referred to as "vacuum resid," with a boiling point of 565° C. and above, which is used as asphalt and coker feed. The present invention is useful in the treatment of any of these oils or fractions for purposes of increasing the proportion of usable oils and other petroleum products that can be extracted from them. Resids, as noted above, are of particular interest.

The properties of resids and other petroleum-derived oils that have been treated by ultrasound in accordance with this invention are significantly improved relative to the same materials prior to treatment. Included among these improved properties are the boiling point and the API gravity. The term "API gravity" is used herein as it is among those skilled in the art of petroleum and petroleum-derived fuels. In general, the term represents a scale of measurement adopted by the American Petroleum Institute, the values on the scale increasing as specific gravity values decrease.

The application of ultrasound in the practice of this invention is performed on an emulsion of the oil in an aqueous fluid. The aqueous fluid can be water or any aqueous solution. The relative amounts of organic and aqueous phases may vary, and while the proportion may affect the efficiency of the process or the ease of handling the fluids, the relative amounts are not critical to this invention. In most cases, however, best results will be achieved when the volume ratio of organic phase to aqueous phase is from about 8:1 to about 1:5, preferably from about 5:1 to about 1:1, and most preferably from about 3:1 to about 1:1.

A hydroperoxide can be included in the emulsion as an optional additive, but is not critical to the success of the conversion. When a hydroperoxide is present, the amount can vary. In most cases, best results will be achieved with a hydroperoxide concentration of from about 10 ppm to about 100 ppm by weight, and preferably from about 15 ppm to about 50 ppm by weight, of the aqueous solution, particularly when the hydroperoxide is $H_2O_2$. Alternatively, when the $H_2O_2$ amount is calculated as a component of the combined organic and aqueous phases, best results will generally be achieved in most systems with an $H_2O_2$ concentration within the range of from about 0.0003% to about 0.03% by volume (as $H_2O_2$), and preferably from about 0.001% to about 0.01%, of the combined phases. For hydroperoxides other than $H_2O_2$, the preferred concentrations will be those of equivalent molar amounts.

In certain embodiments of this invention, a surface active agent or other emulsion stabilizer is included to stabilize the emulsion as the organic and aqueous phases are being prepared for the ultrasound exposure. Certain petroleum fractions contain surface active agents as naturally-occurring components of the fractions, and these agents may serve by themselves to stabilize the emulsion. In other cases, synthetic or non-naturally-occurring surface active agents can be added. Any of the wide variety of known materials that are effective as emulsion stabilizers can be used. These materials are listed in various references such as McCutcheon's Volume 1: Emulsifiers & Detergents—1999 North American Edition, McCutcheon's Division, MC Publishing Co., Glen Rock, N.J., USA, and other published literature. Cationic, anionic and nonionic surfactants can be used. Preferred cationic species are quatemary ammonium salts, quatemary phosphonium salts and crown ethers. Examples of quatemary ammonium salts are tetrabutyl animonium bromide, tetrabutyl ammonium hydrogen sulfate, tributylmethyl ammonium chloride, benzyltrimethyl ammonium chloride, benzyltriethyl ammonium chloride, methyltricaprylyl ammonium chloride, dodecyltrimethyl ammonium bromide, tetraoctyl ammonium bromide, cetyltrimethyl ammonium chloride, and trimethyloctadecyl animonium hydroxide. Quatemary ammonium halides are useful in many systems, and the most preferred are dodecyltrimethyl ammonium bromide and tetraoctyl ammonium bromide.

Surface active agents that will promote the formation of an emulsion between the organic and aqueous phases upon passing the liquids through a common mixing pump, but that will spontaneously separate the product mixture into aqueous and organic phases when allowed to settle can also be used. Once settled, the phases can be separated by decantation or other conventional phase separation procedures. One class of surface active agents that will easily form an emulsion and yet separate readily is liquid aliphatic $C_{15}$-$C_{20}$ hydrocarbons and mixtures of such hydrocarbons, preferably those having a specific gravity of at least about 0.82, and most preferably at least about 0.85. Examples of hydrocarbon mixtures that meet this description and are particularly convenient for use and readily available are mineral oils, preferably heavy or extra heavy mineral oil. The terms "mineral oil," "heavy mineral oil," and "extra heavy mineral oil" are well known in the art and are used herein in the same manner as they are commonly used in the art. Such oils are readily available from commercial chemicals suppliers throughout the world. The amount of mineral oil can vary and the optimal amount may depend on the grade of mineral oil, the composition of the resid or crude oil fraction, the relative amounts of the aqueous and organic phases, and the operating conditions. Appropriate selection will be a matter of routine choice and adjustment to the skilled engineer. In the case of mineral oil, best and most efficient results will generally be obtained using a volume ratio of mineral oil to the organic phase of from about 0.00003 to about 0.003.

Another additive that is useful in forming and stabilizing the emulsion is a dialkyl ether. Preferred dialkyl ethers are those having a normal boiling point of at least 25° C. Both cyclic and acyclic ethers can be used, and are thus represented by the formula $R^1OR^2$ in which $R^1$ and $R^2$ are either separate monovalent alkyl groups or are combined into a single divalent alkyl group, in either case either saturated or unsaturated but preferably saturated. The term "alkyl" is used herein to include both saturated and unsaturated alkyl groups. Whether $R^1$ and $R^2$ are two separate monovalent groups or one combined divalent group, the total number of carbon atoms in $R^1$ and $R^2$ is from 3 to 7, preferably 3 to 6, and most preferably 4 to 6. In an alternative characterization, the dialkyl ether is one whose molecular weight is at most about 100. Examples of dialkyl ethers that would be preferred in the practice of this invention are diethyl ether, methyl tertiary-butyl ether, methyl-n-propyl ether, and methyl isopropyl ether. The most preferred is diethyl ether.

When a dialkyl ether is used, its amount can vary. In most cases, however, best results will be obtained with a volume ratio of ether to the resid or other material to be treated that is within the range of from about 0.00003 to about 0.003, and preferably within the range of from about 0.0001 to about 0.001. The dialkyl ether can be added directly to either the resid or to the aqueous phase, but can also be first diluted in an appropriate solvent to facilitate the addition of the ether to either phase. In a presently preferred method, the ether is first dissolved in kerosene at 1 part by volume ether to 9 parts by volume kerosene, and the resulting solution is added to the resid prior to forming the emulsion.

Another optional component of the system is a metallic catalyst. Examples are transition metal catalysts, preferably metals having atomic numbers of 21 through 29, 39 through 47, and 57 through 79. Particularly preferred metals from this group are nickel, silver, tungsten (and tungstates), and combinations thereof. In certain systems within the scope of this invention, Fenton catalysts (ferrous salts) and metal ion catalysts in general such as iron (II), iron (III), copper (I), copper (II), chromium (III), chromium (VI), molybdenum, tungsten, and vanadium ions, are useful. Of these, iron (II), iron (III), copper (II), and tungsten catalysts are preferred. For some systems, Fenton-type catalysts are preferred, while for others, tungstates are preferred. Tungstates include tungstic acid, substituted tungstic acids such as phosphotungstic acid, and metal tungstates. The metallic catalyst when present will be used in a catalytically effective amount, which means any amount that will enhance the progress of the reactions by which the resid or oil components are upgraded. The catalyst may be present as metal particles, pellets, screens, or any form that has high surface area and can be retained in the ultrasound chamber.

A further improvement in efficiency of the invention is often achievable by preheating the resid, the aqueous fluid, or both, prior to forming the emulsion or to exposing the emulsion to ultrasound. The degree of preheating is not critical and can vary widely, the optimal degree depending on the particular starting material and the ratio of aqueous to organic phases. In general, best results will be obtained by preheating to a temperature within the range of from about 50° C. to about 100° C. For fuels with an API gravity of from about 20 to about 30, preheating is preferably done to a temperature of from about 50° C. to about 75° C., whereas for fuels with an API gravity of from about 8 to about 15, preheating is preferably done to a temperature of from about 85° C. to about 100° C.

Ultrasound consists of soundlike waves at a frequency above the range of normal human hearing, i.e., above 20 kHz (20,000 cycles per second). Ultrasonic energy with frequencies as high as 10 gigahertz (10,000,000,000 cycles per second) has been generated, but for the purposes of this invention, useful results will be achieved with frequencies within the range of from about 30 kHz to about 300 MHz, and preferably within the range of from about 1 MHz to about 100 MHz. Ultrasonic waves can be generated from mechanical, electrical, electromagnetic, or thermal energy sources. The intensity of the sonic energy may also vary widely. For the purposes of this invention, best results will generally be achieved with an intensity ranging from about 30 watts/$cm^2$ to about 300 watts/$cm^2$, or preferably from about 50 watts/$cm^2$ to about 100 watts/$cm^2$. The typical electromagnetic source is a magnetostrictive transducer which converts magnetic energy into ultrasonic energy by applying a strong alternating magnetic field to certain metals, alloys and ferrites. The typical electrical source is a piezoelectric transducer, which uses natural or synthetic single crystals (such as quartz) or ceramics (such as barium titanate or lead zirconate) and applies an alternating electrical voltage across opposite faces of the crystal or ceramic to cause an alternating expansion and contraction of crystal or ceramic at the impressed frequency. Ultrasound has wide applications in such areas as cleaning for the electronics, automotive, aircraft, and precision instruments industries, flow metering for closed systems such as coolants in nuclear power plants or for blood flow in the vascular system, materials testing, machining, soldering and welding, electronics, agriculture, oceanography, and medical imaging. The various methods of producing and applying ultrasonic energy, and commercial suppliers of ultrasound equipment, are well known among those skilled in ultrasound technology.

The exposure time of the emulsion to ultrasound is not critical to the practice or the success of the invention, and the optimal exposure time will vary according to the material being treated. In general, however, effective and useful results can be achieved with a relatively short exposure time. Best results will generally be obtained with exposure times ranging from about 8 seconds to about 150 seconds. For starting materials with API gravities of from about 20 to about 30, the preferred exposure time is from about 8 seconds to about 20 seconds, whereas for fuels with API gravities of from about 8 to about 15, the preferred exposure time is from about 100 seconds to about 150 seconds. After ultrasound exposure, the emulsion is preferably allowed to separate immediately into aqueous and organic phases, the organic phase being the converted starting material, recoverable from the aqueous phase by conventional means.

Improvements in the efficiency and effectiveness of the process can in many cases be achieved by performing the ultrasound exposure in a continuous process in a flow-through ultrasound chamber, and even further improvement can be achieved by recycling the organic phase to the chamber with a fresh supply of water. Recycle can be repeated for a total of three passes through the ultrasound chamber for even better results. Alternatively, the organic phase emerging from the ultrasound chamber can be subjected to a second stage ultrasound treatment in a separate chamber, and possibly a third stage ultrasound treatment in a third chamber, with a fresh supply of water to each chamber.

Ultrasound typically generates heat, and in certain embodiments of this invention it is preferable to remove some of the generated heat to maintain control over the reaction. Heat can be removed by conventional means, such as a liquid coolant jacket or a coolant circulating through a cooling coil in the interior of the ultrasound chamber. Water at atmospheric pressure is an effective coolant for this process. When cooling is achieved by immersing the ultrasound chamber in a coolant bath or by use of a circulating coolant, the coolant may be at a temperature of about 50° C. or less, preferably about 20° C. or less, and more preferably within the range of from about −5° C. to about 20° C. Suitable cooling methods or devices will be readily apparent to those skilled in the art.

Operating conditions in general for the practice of this invention can vary widely, depending on the material being treated and the manner of treatment. The pH of the emulsion, for example, may range from as low as 1 to as high as 10, although best results are presently believed to be achieved within a pH range of 2 to 7. The pressure of the emulsion as it is exposed to ultrasound can likewise vary, ranging from subatmospheric (as low as 5 psia or 0.34 atmosphere) to as high as 3,000 psia (214 atmospheres), although preferably less than about 400 psia (27 atmospheres), and more preferably less than about 50 psia (3.4 atmospheres), and most preferably from about atmospheric pressure to about 50 psia.

The process can be performed either in a batchwise manner or in a continuous-flow operation. Continuous-flow operations are preferred. In a currently preferred system, the ultrasound exposure is performed in a horizontal pipe reactor, 12 inches (30.5 cm) in diameter and 6 feet (1.83 m) in length, although a useful range of dimensions may be a diameter of from 4 inches to 24 inches (10.2 to 61 cm) and a length of 1 foot to 50 feet (30.5 to 1,524 cm), preferably from 6 feet to 12 feet (183 to 366 cm). The pipe is divided longitudinally into 5 sections or cells with perforated vertical walls separating the cells. A horizontal screen in each cell supports the metal catalyst particles and the perforated vertical walls serve to retain the particles in each cell. Ultrasound probes penetrate the top of the pipe and extend into the pipe interior, with one probe extending into each cell. Emulsion is passed through the pipe and thus through each cell in succession, at a rate of approximately 75 gallons/minute (4.7 liters per second, or 2,570 bbl/day). The volume ratio of organic to aqueous phases is 1:0.5. An alternative reactor is a single-chamber continuous-flow reactor such as that described in co-pending U.S. patent application Ser. No. 10/440,445, filed May 16, 2003, entitled "High-Power Ultrasonic Generator and Use in Chemical Reactions," Rudolf W. Gunnerman and Charles I. Richman, inventors. application Ser. No. 10/440,445 is incorporated herein by reference.

The following example is offered for purposes of illustration and is not intended to limit the scope of the invention.

EXAMPLE

An Arab medium crude oil that had been topped, i.e., whose light ends had been removed, was combined with water at a 60:40 volume ratio, with an additive consisting of diethyl ether dissolved in kerosene at an ether:kerosene volume ratio of 1:10 and a 1 part by volume of the ether/kerosene mixture was added to 1,000 parts of the crude oil. The resulting emulsion was exposed to ultrasound in a batch process at a frequency of 17.5 megaherz and a power level of 4 kilowatts for approximately ten seconds. The emulsion was then separated into aqueous and organic phases.

Both the product oil and the oil prior to treatment were analyzed by high-temperature simulated distillation (HTSD), a gas-chromatography technique that is known in the art and described by Villalanti, D.C., et al., in "High Temperature Simulated Distillation Applications in Petroleum Characterization," *Encyclopedia of Analytical Chemistry*, Meyers, R. A., ed., pp. 6726-6741 (John Wiley & Sons Ltd., Chichester, 2000), and ASTM Method D5236095, "Test Method for Distillation of Heavy Hydrocarbon Mixtures (Vacuum Potsill Mixtures)," *Annual Book of ASTM Standards*, vol. 05.03, American Society for Testing and Materials, Philadelphia, 1998. This analysis is performed on a chromatography column with a non-polar stationary phase, the elution times of the hydrocarbon components being calibrated to the atmopheric equivalent boiling point of a hydrogenated polyolefin wax POLYWAX 665 and covering a boiling rage of 36-750° C. (97-1382° F.), covering n-alkanes with chain lengths of $C_5$-$C_{120}$.

The results, expressed as plots of the cumulative volume distilled in liquid volume percent vs. the true boiling point in degrees Fahrenheit, are shown in FIG. 1, in which the starting material is represented by squares, and two tests of the treated material are represented by diamonds and triangles, respectively. It is clear from the plot that the analysis of the treated material was reproducible, and that the boiling point distribution of the material was shifted downward along the entire curve, with a maximum shift of 25-30° F. in the boiling point range of approximately 400-600° F.

What is claimed is:

1. A process for treating a petroleum residuum to convert components of said residuum having boiling temperatures ranging from about 400° F. to about 800° F. prior to treatment to products having boiling points that are lower by at least about 20° F., said process comprising:

(a) combining said petroleum residuum with an aqueous liquid and an additive selected from the group consisting of liquid aliphatic $C_{15}$-$C_{20}$ hydrocarbons and dialkyl ethers to form an emulsion, (b) exposing said emulsion to ultrasound, (c) recovering an organic phase from said emulsion after said exposure.

2. The process of claim 1 wherein step (a) comprises combining said petroleum residuum with said aqueous liquid at a (petroleum residuum):(aqueous liquid) volume ration of from about 8:1 to about 1:5.

3. The process of claim 1 wherein step (a) comprises combining said petroleum residuum with said aqueous liquid at a (petroleum residuum):(aqueous liquid) volume ration of from about 5:1 to about 1:1.

4. The process of claim 1 wherein step (a) comprises combining said petroleum residuum with said aqueous liquid at a (petroleum residuum):(aqueous liquid) volume ration of from about 3:1 to about 1:1.

5. The process of claim 1 wherein step (b) is performed at a frequency ranging from about 30 kHz to about 300 MHz.

6. The process of claim 1 wherein step (b) is performed at a frequency ranging from about 1 MHz to about 100 MHz.

7. The process of claim 1 wherein step (b) is performed at an exposure time of from about 8 seconds to about 150 seconds.

8. The process of claim 1 wherein said additive consists of one or more liquid aliphatic $C_{15}$-$C_{20}$ hydrocarbons.

9. The process of claim 8 wherein said liquid aliphatic hydrocarbons have a specific gravity of at least about 0.82.

10. The process of claim 8 wherein said additive is mineral oil.

11. The process of claim 1 wherein said additive is a dialkyl ether.

12. The process of claim 11 wherein said dialkyl ether is a member selected from the group consisting of diethyl ether, methyl tertiary-butyl ether, methyl-n-propyl ether, and methyl isopropyl ether.

13. The process of claim 11 wherein said dialkyl ether is diethyl ether.

* * * * *